US006915669B2

(12) United States Patent
Hedegaard

(10) Patent No.: US 6,915,669 B2
(45) Date of Patent: Jul. 12, 2005

(54) METHOD AND MACHINE FOR STRETCHING PELT ON PELT-BOARDS

(75) Inventor: Jens Hedegaard, Holstebro (DK)

(73) Assignee: Majgaard Invest ApS, Holstebro (DK)

( * ) Notice: Subject to any disclaimer, the term of this patent is extended or adjusted under 35 U.S.C. 154(b) by 76 days.

(21) Appl. No.: 10/432,839

(22) PCT Filed: Nov. 28, 2001

(86) PCT No.: PCT/DK01/00790

§ 371 (c)(1),
(2), (4) Date: Oct. 31, 2003

(87) PCT Pub. No.: WO02/44428

PCT Pub. Date: Jun. 6, 2002

(65) Prior Publication Data

US 2004/0060330 A1 Apr. 1, 2004

(30) Foreign Application Priority Data

Nov. 28, 2000 (DK) ..... 2000 01793

(51) Int. Cl.[7] ..... C14B 1/26
(52) U.S. Cl. ..... 69/19.3
(58) Field of Search ..... 69/1, 19, 19.1–19.3, 69/21–23

(56) References Cited

U.S. PATENT DOCUMENTS 3,048,995 A * 8/1962 Browning ..... 69/46
3,204,435 A * 9/1965 Olson ..... 69/19.1
4,381,654 A * 5/1983 Baldridge ..... 69/19.2
4,389,795 A * 6/1983 Craggs et al. ..... 34/103
4,787,221 A * 11/1988 Johansson ..... 69/40
4,848,108 A * 7/1989 Thompson ..... 69/19.2
5,564,293 A * 10/1996 Black et al. ..... 69/19.2

FOREIGN PATENT DOCUMENTS

DK 156515 B 9/1989
DK 169525 11/1994

OTHER PUBLICATIONS

Abstract No. 92–275247/33, Oct. 5, 1989,1992 Derwent Publications LTD.

* cited by examiner

*Primary Examiner*—Gary L. Welch
(74) *Attorney, Agent, or Firm*—Nixon Peabody LLP; David S. Safran

(57) ABSTRACT

By a new method for the fastening of pelts stretched on pelt-boards, the belt is secured in a stretched position on the pelt-board by means of a sleeve/bag which is drawn over and around the pelt, so that the pelt is pressed in and locked against the pelt-board by means of the sleeve/bag. The method gives rise to the need for the pelts to be stretched out longer on the pelt-board than has hitherto been possible without damaging the pelts, inasmuch as the pelts will have a tendency to shrink slightly more when they are not fastened to the pelt-board by means of the staples traditionally used. During the stretching of the pelt in a pelt processing machine, by imparting a vibrating movement to the pelt-board and/or the gripping elements while implementing the relative displacement in the longitudinal direction of the pelt-board respectively between the holding elements for the fastening of the pelt, and the first and/or second set of gripping elements for the stretching of the pelt, for example a mink pelt placed loosely beforehand on the pelt-board, it is achieved that the pelt can be stretch out to the desired length without damage to the pelt.

20 Claims, 1 Drawing Sheet

METHOD AND MACHINE FOR STRETCHING PELT ON PELT-BOARDS

Figure 1:
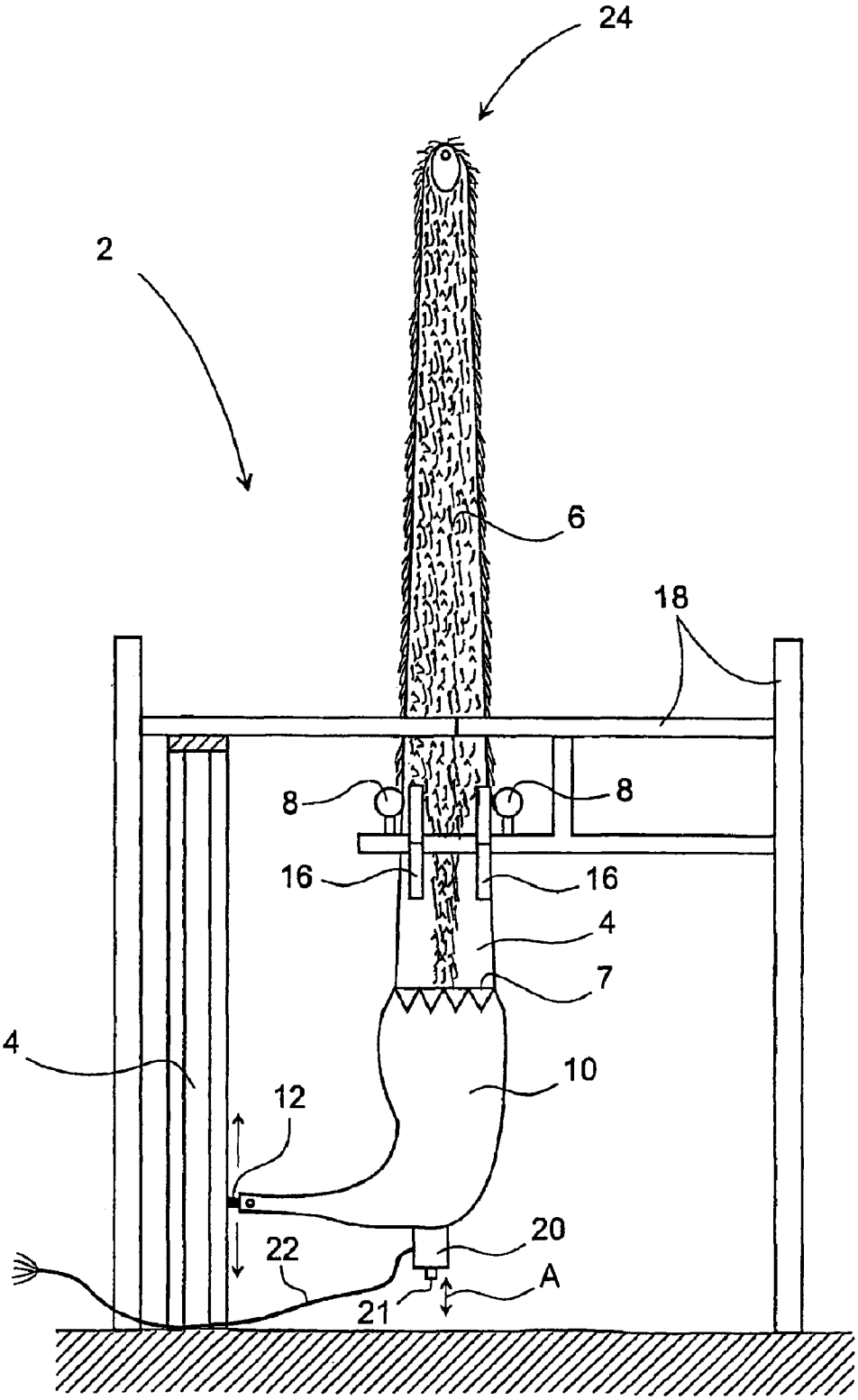

The present invention relates to method for the stretching of pelts on pelt-boards by a pelt-processing machine which comprises means for the execution of a relative displacement between a pelt-board on which a pelt is placed between holding elements and gripping elements for the securing of the pelt during the stretching. The invention also relates to a pelt-processing machine for the execution of the disclosed method.

A pelt processing machine for the stretching of pelts on pelt-boards typically consists of an apparatus comprising first holding elements for the securing of a pelt-board on which a pelt is applied in a loose manner, and at least a first set of gripping elements for the securing of the back-side of the pelt and/or a second set of gripping elements for the securing of the leg side of the pelt, and means for the execution of a relative displacement respectively between the pelt-board with the pelt and the first and/or second set of gripping elements in the longitudinal direction for the stretching of a pelt, for example a mink pelt, placed loosely beforehand on the pelt-board.

Such a method and machine are known for example from DK B 169 525, which discloses a pelt-processing machine which comprises gripping elements which are movable and can be activated by a force for the securing of the pelt while it is being stretched.

This machine also distinguishes itself by comprising a first set of ideal-sensors, corresponding to ideal lengths of the pelts, and a second set of sensors for increased traction effect, where the sensors are placed in positions with one sensor between two ideal-sensors in the ideal set, and arranged in such a manner that the stretching of the pelt on the pelt-board is brought to an end if the end of the pelt does not move past an ideal-sensor within a given time and is at or just past the ideal length sensor, and moreover; if the end of the pelt reaches a sensor for increased traction effect between two ideal length sensors, the stretching of the pelt is continued with increased strength until the next ideal length sensor is reached, after which the stretching ceases, and the pelt is fastened to the pelt-board by means of a number of staples which are driven through the pelt and into the pelt-board, and the stretching of the pelt is completed. There is hereby achieved a controlled stretching of a pelt which beforehand is measured to be able to be stretched out to an empirical size in the pelt processing machine.

The above method for the stretching of pelts on pelt-boards is good enough in itself, and has gained widespread use within the field of fur production, inasmuch as it is effective and provides the possibility for achieving as great a length of the pelt as possible in relation to the basic size of the pelt.

However, the method used for the fastening of the pelt in the stretched-out position on the pelt-board with staples has the result that, during the drying of the pelt, elongated holes arise in the pelt which reduces its value, in that pelts with holes can not be used in the manufacture of fur products. Moreover, it is precisely that end of the pelt which is fastened to the pelt-board with staples which is the most valuable part, inasmuch as here the pelts have the greatest breadth, and the back pelt is the most valuable.

The above-mentioned problem has led to the development of a new method for the fastening of pelts stretched on a pelt-board. With the new method, use is not made of staples for the fastening of the pelts on the pelt-boards. Instead, use is made of a sleeve/bag which is drawn over the pelt when this is stretched out in the machine, so that the pelt is pressed against the pelt-board and locked by means of the sleeve/bag, whereby it is secured in the stretched-out position. The holes which are otherwise left in the pelts by use of the commonly-known method are hereby avoided, and thus it will be possible to obtain higher prices for the pelts when these are sold.

The new method gives rise, however, to a need to be able the stretch the pelts longer out on the pelt-board, inasmuch as experience has shown that the pelts will have a tendency to shrink a little more when they are not fastened to the pelt-board with staples. However, it is almost impossible to stretch the pelts sufficiently by means of the known technique and the known pelt processing machines, which in the stretching execute a purely relative oppositely-directed displacement between the board and the pelt and the gripping claws. If the pelts are stretched more in these machines, they will simply be destroyed.

The object of the invention is thus to provide a method for the stretching of pelts which permits the pelts to be stretched to a length which is greater than the ideal length for the relevant pelt applied loosely to the pelt-board.

This object is achieved by a vibrating movement being induced in the holding elements for the pelt-board and/or the means for execution of the relative displacement between the gripping elements and the board, and/or the gripping elements, during the execution of the relative displacement respectively between the board and the gripping elements in the longitudinal direction of the board for the stretching of the pelt, for example a mink pelt, which beforehand is applied loosely on the pelt-board.

The effect hereof is surprising, inasmuch as trials with this method have shown that it is possible to stretch a pelt to approx. 4–5% more than to the length that a given size of pelt drawn loosely on the board will normally be able to be stretched in a pelt-processing machine, without the pelt suffering any damage.

The effect of the use of the method of stretching pelts on pelt-boards without fastening by means of staples is thus that the size of the pelt after drying, by use of the holding sleeves/bags for the fastening of the pelt stretched on the pelt-board, will be at least the same as with the hitherto-known method where the pelts are held stretched out on the board by means of staples, but with the important difference that pelts which are fastened on pelt-boards with holding sleeves/bags do not have holes resulting from the use of staples.

In certain cases, the pelts which are stretched by the method according to the invention and fastened on the pelt-board during the drying process by means of the over-drawn sleeves/bags are even longer than pelts which are stretched and fastened on the board by means of staples.

An additional effect of the method according to the invention, if this is used in connection with the stretching and fastening of pelts on pelt-boards in accordance with the traditional method, where the pelts are fastened on the boards by staples, will be that a pelt can be stretched out to a larger size category than by stretching without the use of vibration during the stretching, of course with slightly larger holes in the pelt after the drying, but despite all else a higher price can also be obtained for these pelts.

With the object of avoiding over-stretching of the pelts in connection with the stretching of these by the method disclosed according to the invention, it can be an advantage for the method to comprise a monitoring of the stretching of the pelt by a first set of ideal-sensors on the pelt processing machine, corresponding to ideal lengths of the pelts, together with a second set of sensors for increased traction effect, where the sensors are placed in positions with a sensor between two ideal length sensors in the ideal set, and arranged so that the stretching of the pelt on the board is brought to an end if the end of the pelt does not move past an ideal length sensor within a given time and is at or just past the ideal length sensor, and moreover, if the end of the pelt reaches a sensor for increased traction effect between two ideal length sensors, the stretching of the pelt is continued with increased strength until the next ideal length sensor is reached, whereupon the stretching is stopped.

An apparatus for the execution of the method according to the invention thus consists of a pelt-processing machine of any known kind, and comprising at least first holding elements for the fastening of a pelt-board on which a pelt is placed, and at least a first set of gripping elements for securing in the back side of the pelt, and/or a second set of gripping elements for securing the leg side of the pelt, and means for the execution of a relative displacement in the longitudinal direction of the pelt-board respectively between the holding elements for fastening of the board and the first and/or second set of gripping elements for the stretching of the pelt, for example a mink pelt, placed loosely beforehand on the pelt-board, which is characterised in that the holding elements for the pelt-board and/or the means for the execution of said relative displacement between the board with the pelt and/or the gripping elements for the pelt on the board are provided with a vibrator.

With the view to achieving the most effective function of the vibrator, this can with advantage be arranged so that the vibrating movement gives rise to a vibrating movement oriented in the longitudinal direction of the pelt-board.

The apparatus for the execution of the invention can with advantage further comprise a first set of ideal-sensors corresponding to ideal lengths of the pelts, and a second set of sensors for increased traction effect, where the sensors are placed in positions with one sensor between two ideal length sensors in the ideal set, and arranged so that the stretching of the pelts on the board is brought to an end if the end of the pelt does not move past an ideal length sensor within a given time and is at or just past the ideal length sensor, and moreover, if the end of the pelt reaches a sensor for increased traction effect between two ideal length sensors, the stretching of the pelt is continued with increased strength until the next ideal length sensor is reached, whereupon the stretching is stopped.

As compressed air is often available at pelt processing machines, the vibrator can with advantage consist of a pneumatic vibrator unit, but it can naturally also be driven by an electric motor or a servo-motor, or it can be a hydraulic vibrator unit.

In the following, the invention is explained in more detail with reference to the drawing, where FIG. 1 is a front view of a section of an embodiment of a pelt processing machine for execution of the method according to the invention.

In FIG. 1 there is shown a section of an embodiment of a pelt processing machine 2 for execution of the method according to the invention, and in which there is inserted a pelt-board 4 over which a mink pelt 6 has been drawn in a loose manner.

The pelt-board is secured in a substantially vertical position by not-shown holding elements, and is supported against tipping over to the sides by guide rollers 8, and the foot 7 of the pelt-board is placed on a displaceable seating 10, which via a semi-rigid connection 12 is connected to a not-shown piston in an air cylinder 14 for execution of a vertical displacement of the pelt-board 4.

As indicated, the back side of the pelt 6 is secured by means of gripping elements 16 which are fastened to the frame 18 of the pelt-processing machine.

The displaceable seating 10 further comprises a vibrator unit 20, which via the pressure pipe 22 is connected to a not-shown source of compressed air. The vibrator unit 20 comprises an axially-displaceable piston 21 which, in the activation of the vibrator, is displaced in a reversing movement (cf. the arrow A) in the longitudinal direction of the pelt-board, whereby a jolting or jerking movement is imparted to the displaceable seating 10 and therewith to the pelt-board 4 in the longitudinal direction of the board.

With the stretching of the pelt 6, the air cylinder 14 and the vibrator 20 are activated, whereby the seating 10 and therewith the pelt-board 4 are displaced in the vertical direction, while at the same time the pelt 6 is secured by the gripping elements 16, whereby the pelt 6 is stretched-out/tightened by a combination movement which consists partly of the vertical displacement of the board 4 with the pelt 6, and the jolting/jerking movement of the board 4 in its longitudinal direction.

When a suitable length/stretching of the pelt 6 has been achieved in relation to empirical values which are determined in relation to the size of the pelt when this is applied loosely to the pelt-board 4, the pelt 6 is fastened to the pelt-board 4, either by means of staples or by means of a retaining sleeve/bag item which is drawn over the pelt from above (the nose end 24 of the pelt), after which the gripping elements 16 are slackened and the holding elements for the pelt-board 4 are loosened, and the pelt-board with the now stretched, secured pelt 6 is taken out of the pelt processing machine 2, and the operation is repeated.

The execution of the jolting/jerking movement of the pelt-board 4 by the vibrator unit 20, in combination with the vertical displacement of the seating 10 by the air cylinder 14, gives rise to the possibility for the stretching of the pelt to be effected to a length which is 4–5% longer than that length to which it is normally possible for a pelt of a given size to be stretched.

Compensation will hereby be able to be made for the shrinkage of the pelt during the drying, which with staple free fastening of the stretched pelt on a pelt-board will always be slightly greater than with the traditional use of staples which are driven through the pelt and into the pelt-board. Furthermore, trials have shown that with the use of the method according to the invention for the stretching of pelts in combination with staple-free fastening by means of drawn-over sleeves/bag items, it will be possible to achieve pelts of larger sizes compared with those sizes which can be achieved by the stretching and the fastening of the pelts with staples in the traditional manner.

All else being equal, the invention must be understood to be a revolutionary development within the industry, regardless of whether use is made of staples or retaining sleeves/bag items for the securing of the stretched pelts on the pelt-boards, inasmuch as in the first-mentioned case the pelts achieved will have larger parts without holes, and in the latter case, where use is made of retaining sleeves/bag items, the pelts will be of at least that size category which conforms with the pelt size actually measured, or if possible a size category above.

The invention shall thus in no way be limited to the processing of pelts on pelt-boards without the use of staples (with retaining sleeves/bag items), but is envisaged for use on all types of pelt-processing machines, also those where use is made of staples for securing of the pelt stretched on the pelt-board by the processing machine.

What is claimed is:

1. Method for the stretching of pelts (6) on pelt-boards (4) by a pelt-processing machine (2) which comprises means (10, 12, 14) for the execution of a relative displacement between a pelt-board (4) on which a pelt (6) is placed between holding elements, and gripping elements (16) for the securing of the pelt (6) during the stretching, characterised in that a vibrating movement is applied to the holding elements for the pelt-board (4) and/or the means (10, 12, 14) for the execution of the relative displacement between the gripping elements (16) and the pelt-board (4), and/or the gripping elements (16), during the execution of the relative displacement respectively between the pelt-board (4) and the gripping elements (16) in the longitudinal direction of the pelt-board, for the stretching of the pelt (6) which beforehand is applied loosely on the pelt-board.

2. Method for the stretching of pelts (6) on pelt-boards (4) according to claim 1, characterised in that the stretching of the pelt is monitored by a first set of ideal sensors on the pelt-processing machine which correspond to ideal lengths of the pelts, and together with a second set of sensors for increased traction effect, where the sensors are placed in positions with a sensor between two ideal-length sensors in the ideal set, and arranged in such a manner that the stretching of the pelt on the pelt-board is brought to an end if the end of the pelt does not move past an ideal-length sensor within a given time and is at or just past the ideal-length sensor, and furthermore; if the end of the pelt reaches a sensor for increased traction effect between two ideal-length sensors, the stretching of the pelt is continued with increased strength until the next ideal-length sensor is reached, whereupon the stretching is stopped.

3. Method according to claim 2, characterised in that the vibrating movement gives rise to a vibrating movement oriented in the longitudinal direction of the pelt-board.

4. Method according to claim 1, characterised in that the vibrating movement gives rise to a vibrating movement oriented in the longitudinal direction of the pelt-board.

5. A pelt-processing apparatus comprising at least a first set of holding elements for the fastening of a pelt-board (4) on which a pelt (6) is placed, and at least a first set of gripping elements (16) for fastening in the back side of the pelt, and/or a second set of gripping elements for the fastening of the leg side of the pelt, and means (10) for the execution of a relative displacement in the longitudinal direction of the pelt-board respectively between the holding elements for fastening of the pelt-board and the first and/or second set of gripping elements (16), for the stretching of a pelt which beforehand is placed loosely on the pelt-board, characterised in that the holding elements for the pelt-board (4) and/or the means (10, 12, 14) for the execution of said relative displacement between the pelt-board (4) with the pelt (6) and/or the gripping elements (16) for the pelt (6) on the pelt-board (4), are provided with a vibrator (20).

6. Apparatus according to claim 5, characterised in that the vibrator (20) is arranged in such a manner that the vibrating movement gives rise to a vibrating movement oriented mainly in the longitudinal direction of the pelt-board.

7. Apparatus according to claim 6, characterised in that it comprises a first set of ideal sensors corresponding to ideal lengths of the pelts, and a second set of sensors for increased traction effect, where the sensors are placed in positions with one sensor between two ideal-length sensors in the ideal-length set, and arranged in such a manner that the stretching of the pelt on the pelt-board is brought to an end if the end of the pelt does not move past an ideal-length sensor within a given time and is at or just past the ideal-length sensor, and furthermore; if the end of the pelt reaches a sensor for increased traction effect between two ideal-length sensors, the stretching of the pelt is continued with increased strength until the next ideal-length sensor is reached, whereupon the stretching is stopped.

8. Apparatus according to claim 7, characterised in that the vibrator (20) consists of a pneumatic vibrator unit.

9. Apparatus according to claim 7, characterised in that the vibrator (20) consists of a vibrator unit (20) driven by an electric motor.

10. Apparatus according to claim 7, characterised in that the vibrator (20) is driven by a servo-motor.

11. Apparatus according to claim 7, characterised in that the vibrator (20) consists of a hydraulic vibrator.

12. Apparatus according to claim 6, characterized in that the vibrator (20) consists of a pneumatic vibrator unit.

13. Apparatus according to claim 6, characterised in that the vibrator (20) consists of a vibrator unit (20) driven by an electric motor.

14. Apparatus according to claim 6, characterised in that the vibrator (20) is driven by a servo-motor.

15. Apparatus according to claim 6, characterised in that the vibrator (20) consists of a hydraulic vibrator.

16. Apparatus according to claim 5, characterised in that the vibrator (20) consists of a pneumatic vibrator unit.

17. Apparatus according to claim 5, characterised in that the vibrator (20) consists of a vibrator unit (20) driven by an electric motor.

18. Apparatus according to claim 5, characterised in that the vibrator (20) is driven by a servo-motor.

19. Apparatus according to claim 5, characterised in that the vibrator (20) consists of a hydraulic vibrator.

20. Apparatus according to claim 5, characterised in that it comprises a first set increased traction effect, where the sensors are placed in positions with one sensor between two ideal-length sensors in the ideal-length set, and arranged in such a manner that the stretching of the pelt on the pelt-board is brought to an end if the end of the pelt does nor move past an ideal-length sensor within a given time and is at or just past the ideal-length sensor, and furthermore; if the end of the pelt reaches a sensor for increased traction effect between two ideal-length sensors, the stretching of the pelt is continued with increased strength until the next ideal-length sensor is reached, whereupon the stretching is stopped.

* * * * *